US007886551B2

(12) United States Patent
Matsui et al.

(10) Patent No.: US 7,886,551 B2
(45) Date of Patent: Feb. 15, 2011

(54) HUMIDITY CONTROL SYSTEM

(75) Inventors: Nobuki Matsui, Osaka (JP); Yoshinori Narikawa, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 497 days.

(21) Appl. No.: 11/921,296

(22) PCT Filed: May 30, 2006

(86) PCT No.: PCT/JP2006/310748

§ 371 (c)(1),
(2), (4) Date: Nov. 29, 2007

(87) PCT Pub. No.: WO2006/129645

PCT Pub. Date: Dec. 7, 2006

(65) Prior Publication Data

US 2009/0084121 A1 Apr. 2, 2009

(30) Foreign Application Priority Data

May 30, 2005 (JP) ..... 2005-157658

(51) Int. Cl.
*F25D 17/06* (2006.01)

(52) U.S. Cl. ..... 62/225; 62/158

(58) Field of Classification Search ..... 62/141, 62/158, 176.1, 255, 498, 271
See application file for complete search history.

(56) References Cited

U.S. PATENT DOCUMENTS 4,499,739 A * 2/1985 Matsuoka et al. ..... 62/212
4,686,835 A * 8/1987 Alsenz ..... 62/223
4,835,980 A * 6/1989 Oyanagi et al. ..... 62/212
5,243,829 A * 9/1993 Bessler ..... 62/126
5,415,008 A * 5/1995 Bessler ..... 62/212
5,749,238 A * 5/1998 Schmidt ..... 62/211
5,910,159 A * 6/1999 Matsuo et al. ..... 62/158
6,843,067 B2 1/2005 Lee et al.
7,472,553 B2 * 1/2009 Ikegami et al. ..... 62/94
2004/0098997 A1 5/2004 Lee et al.
2005/0022544 A1 2/2005 Chin et al.

FOREIGN PATENT DOCUMENTS

EP 1 524 475 A1 4/2005
GB 2 258 302 A 2/1993
JP 2003-232539 A 8/2003
JP 2004-294048 A 10/2004
JP 2004353891 12/2004
KR 10-2004-0045094 6/2004

* cited by examiner

*Primary Examiner*—George Nguyen
(74) *Attorney, Agent, or Firm*—Birch, Stewart, Kolasch & Birch, LLP

(57) ABSTRACT

A humidity control system (10) includes a refrigerant circuit (50) including a compressor (53), a first adsorption heat exchanger (51) carrying an adsorbent thereon, an expansion valve (55) adjustable in opening and a second adsorption heat exchanger (52) carrying an adsorbent thereon, supplies humidity-controlled air to a room by operating alternately in a first batch mode in which the second adsorption heat exchanger (52) adsorbs moisture in air and the first adsorption heat exchanger (51) releases moisture to air and a second batch mode in which the first adsorption heat exchanger (51) adsorbs moisture in air and the second adsorption heat exchanger (52) releases moisture to air, and controls the opening of the expansion valve (55), when a valve control start time has come a predetermined time after the start of each batch mode, so that the degree of superheat of refrigerant in the refrigerant circuit (50) reaches a predetermined value.

3 Claims, 3 Drawing Sheets

HUMIDITY CONTROL SYSTEM

TECHNICAL FIELD

This invention relates to a humidity control system and particularly relates to measures to control the opening of an expansion valve in the humidity control system.

BACKGROUND ART

Humidity control systems are conventionally known which include a refrigerant circuit contained in a casing and operating in a vapor compression refrigeration cycle and control the humidity in a room by switching the air flow path in the casing (see, for example, Patent Document 1).

The refrigerant circuit in such a humidity control system includes two heat exchangers carrying an adsorbent thereon and is configured to reversibly switch the direction of refrigerant circulation.

The humidity control system during a dehumidification operation operates in a first batch mode of dehumidifying outside air taken in the system through the first heat exchanger serving as an evaporator and then supplying it to a room and, concurrently, giving to room air taken in the system moisture released from the adsorbent of the second heat exchanger serving as a condenser to regenerate the adsorbent and exhausting the humidified room air. Next, the humidity control system during the dehumidification operation switches the direction of refrigerant circulation in the refrigerant circuit and the air flow path in the casing to operate in a second batch mode of dehumidifying outside air taken in the system through the second heat exchanger serving as an evaporator and then supplying it to the room and, concurrently, giving to room air taken in the system moisture released from the adsorbent of the first heat exchanger serving as a condenser to regenerate the adsorbent and exhausting the humidified room air.

On the other hand, the humidity control system during a humidification operation operates in a first batch mode of humidifying outside air through the first heat exchanger serving as a condenser and then supplying it to the room and, concurrently, dehumidifying room air through the second heat exchanger serving as an evaporator and then exhausting it, and a second batch mode of humidifying outside air through the second heat exchanger serving as a condenser and then supplying it to the room and, concurrently, dehumidifying room air through the first heat exchanger serving as an evaporator and then exhausting it.

In this manner, the humidity control system controls the humidity in the room by operating alternately in the first and second batch modes.

Patent Document 1: Published Japanese Patent Application No. 2004-294048

DISCLOSURE OF THE INVENTION

Problem to be Solved by the Invention

However, the known humidity control system has no measure to control the opening of an expansion valve in the refrigerant circuit. Therefore, there is a demand to provide a new means of controlling the expansion valve.

Specifically, the refrigerant circuit of the above humidity control system switches between the first and second batch modes, for example, every three minutes. Therefore, the variation in the degree of refrigerant superheat is larger than that in air conditioners, which invites a problem that controls on expansion valves employed in conventional air conditioners cannot be applied to the humidity control system as they are.

The present invention has been made in view of the above point and, therefore, an object of the invention is to provide new means of controlling the expansion valve in the humidity control system.

Means to Solve the Problem

A first aspect of the invention is directed to a humidity control system that includes a refrigerant circuit (50) including a compressor (53), a first heat exchanger (51) carrying an adsorbent thereon, an expansion valve (55) adjustable in opening and a second heat exchanger (52) carrying an adsorbent thereon and supplies humidity-controlled air to a room by operating alternately in a first batch mode in which the second heat exchanger (52) adsorbs moisture in air and the first heat exchanger (51) releases moisture to air and a second batch mode in which the first heat exchanger (51) adsorbs moisture in air and the second heat exchanger (52) releases moisture to air. In addition, the humidity control system further includes an opening control means (32) that, when a valve control start time has come a predetermined time after the start of each of the first and second batch modes, controls the opening of the expansion valve (55) so that the degree of superheat of refrigerant in the refrigerant circuit (50) reaches a predetermined value.

According to the first aspect of the invention, since the humidity control system performs a humidity control operation by operating alternately in the first batch mode and the second batch mode, the opening control means (32) controls the opening of the expansion valve (55), when the valve control start time T has come after the start of each batch mode, so that the degree of refrigerant superheat reaches the predetermined value.

For example, the opening control means (32) in principle controls the opening of the expansion valve (55) to keep a fixed degree until the valve control start time T in each batch mode has come, i.e., until 168 seconds after the switching to the batch mode and the start thereof. When the valve control start time T has come, i.e., after 168 seconds have passed since the start of the batch mode, the opening control means (32) controls the opening of the expansion valve (55) so that the degree of refrigerant superheat reaches the specified valve, 5° C.

Furthermore, in a second aspect of the invention, related to the first aspect of the invention, the opening control means (32) is configured to keep the opening of the expansion valve (55) at a fixed value until the valve control start time in each of the first and second batch modes has come.

According to the second aspect of the invention, the expansion valve (55) is controlled to keep the fixed opening until the valve control start time T in each batch mode has come.

For example, the opening control means (32) in principle controls the opening of the expansion valve (55) to keep a fixed degree until the valve control start time T in each batch mode has come, i.e., until 168 seconds after the switching to the batch mode and the start thereof. When the valve control start time T has come, i.e., after 168 seconds have passed since the start of the batch mode, the opening control means (32) controls the opening of the expansion valve (55) so that the degree of refrigerant superheat reaches the specified valve, 5° C.

Furthermore, in a third aspect of the invention, related to the first aspect of the invention, the humidity control system further includes an opening decreasing means (35) that, when the degree of superheat of the refrigerant in the refrigerant circuit (50) falls below a target value before the valve control start time in each of the first and second batch modes comes, decreases the opening control value of the opening control means (32) to allow the opening of the expansion valve (55) to be reduced.

According to the third aspect of the invention, if the degree of refrigerant superheat falls below the target value before the valve control start time T in each batch mode comes and when the opening of the expansion valve (55) is controlled by the opening control means (32), the opening decreasing means (35) controls the opening control means (32) to reduce the opening of the expansion valve (55).

Furthermore, in a fourth aspect of the invention, related to the first aspect of the invention, the humidity control system further includes an opening increasing means (36) that, when the degree of superheat of the refrigerant in the refrigerant circuit (50) rises above a specified degree of superheat before the valve control start time in each of the first and second batch modes comes, increases the opening control value of the opening control means (32) to allow the opening of the expansion valve (55) to be increased.

According to the fourth aspect of the invention, if the degree of refrigerant superheat rises above the specified degree of superheat before the valve control start time T in each batch mode comes and when the opening of the expansion valve (55) is controlled by the opening control means (32), the opening increasing means (36) controls the opening control means (32) to increase the opening of the expansion valve (55).

Effects of the Invention

According to the present invention, the opening of the expansion valve (55) is controlled, when the valve control start time comes after the start of each batch mode, so that the degree of refrigerant superheat reaches the predetermined value. Therefore, the opening of the expansion valve (55) can be relatively stably controlled. To be more specific, since each batch mode is changed to the other batch mode in a short time, the degree of refrigerant superheat may significantly change in each batch mode. To cope with this, the opening of the expansion valve (55) is controlled near the end of each batch mode so that the degree of refrigerant superheat reaches the predetermined value. Thus, a stable control on the opening of the expansion valve (55) can be implemented.

Furthermore, according to the second aspect of the invention, since the opening of the expansion valve (55) is kept at a fixed value from the start of each batch mode to the valve control start time, the control on the opening of the expansion valve (55) can be stabilized.

Furthermore, according to the third aspect of the invention, since the opening of the expansion valve (55) is decreased when the degree of refrigerant superheat falls below the target value before the valve control start time T in each batch mode, so-called wet operation can be prevented, thereby preventing return of liquid refrigerant to the compressor (53).

Furthermore, according to the fourth aspect of the invention, since the opening of the expansion valve (55) is increased when the degree of refrigerant superheat rises above the specified degree before the valve control start time T in each batch mode, the superheating of the compressor (53) can be surely prevented.

BRIEF DESCRIPTION OF THE DRAWINGS

FIG. 1 is a piping diagram showing the structure of a refrigerant circuit according to an embodiment of the invention, wherein FIG. 1A is a piping diagram showing the operational behavior during a first batch mode and FIG. 1B is a piping diagram showing the operational behavior during a second batch mode.

LIST OF REFERENCE NUMERALS

Figure 1:
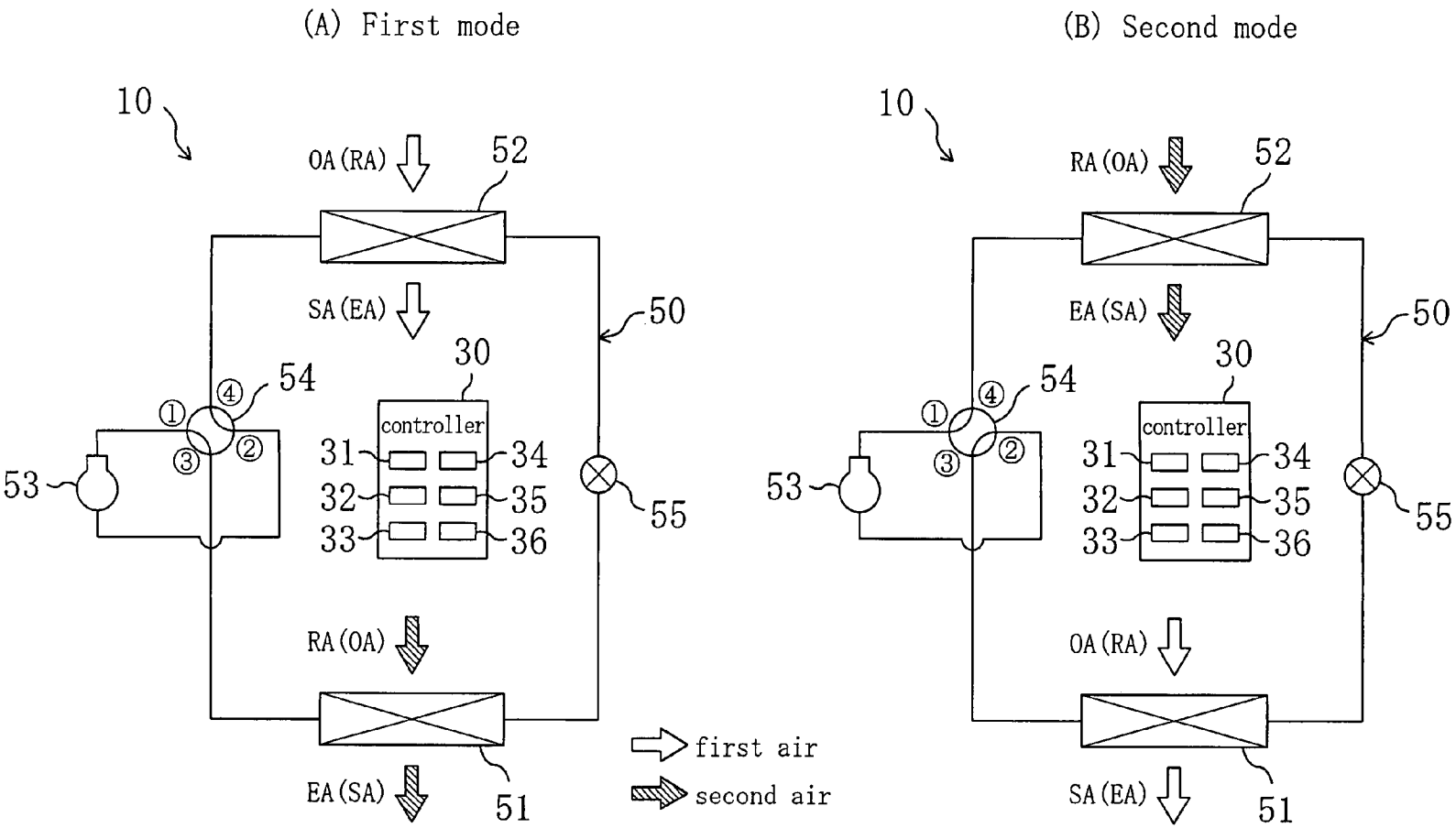

10 humidity control system
30 controller
31 operation control means
32 opening control means
33 initialization means
34 correction means
35 opening decreasing means
36 opening increasing means
50 refrigerant circuit
51 compressor
52 first adsorption heat exchanger
53 second adsorption heat exchanger
54 four-way selector valve
55 expansion valve

BEST MODE FOR CARRYING OUT THE INVENTION

Hereinafter, embodiments of the invention will be described in detail with reference to the drawings.

This embodiment of the invention relates to a humidity control system (10) for humidifying and dehumidifying air as shown in FIG. 1. The humidity control system (10) is configured to be capable of a dehumidification operation in which dehumidified air is supplied to a room and a humidification operation in which humidified air is supplied to the room.

The humidity control system (10) includes a refrigerant circuit (50). As shown in FIG. 1, the refrigerant circuit (50) is a closed circuit including a first adsorption heat exchanger (51) as a first heat exchanger, a second adsorption heat exchanger (52) as a second heat exchanger, a compressor (53), a four-way selector valve (54) as a directional control mechanism, and an expansion valve (55) as an expansion mechanism. The refrigerant circuit (50) operates in a vapor compression refrigeration cycle by circulating therein refrigerant with which the refrigerant circuit (50) is filled.

In the refrigerant circuit (50), the compressor (53) is connected at its discharge side to a first port of the four-way selector valve (54) and connected at its suction side to a second port of the four-way selector valve (54). One end of the first adsorption heat exchanger (51) is connected to a third port of the four-way selector valve (54). The other end of the first adsorption heat exchanger (51) is connected via the expansion valve (55) to one end of the second adsorption heat exchanger (52). The other end of the second adsorption heat exchanger (52) is connected to a fourth port of the four-way selector valve (54).

The four-way selector valve (54) is switchable between a first position in which the first and third ports are communicated with each other and the second and fourth ports are communicated with each other (the position shown in FIG. 1A) and a second position in which the first and fourth ports are communicated with each other and the second and third ports are communicated with each other (the position shown in FIG. 1B).

Figure 2:
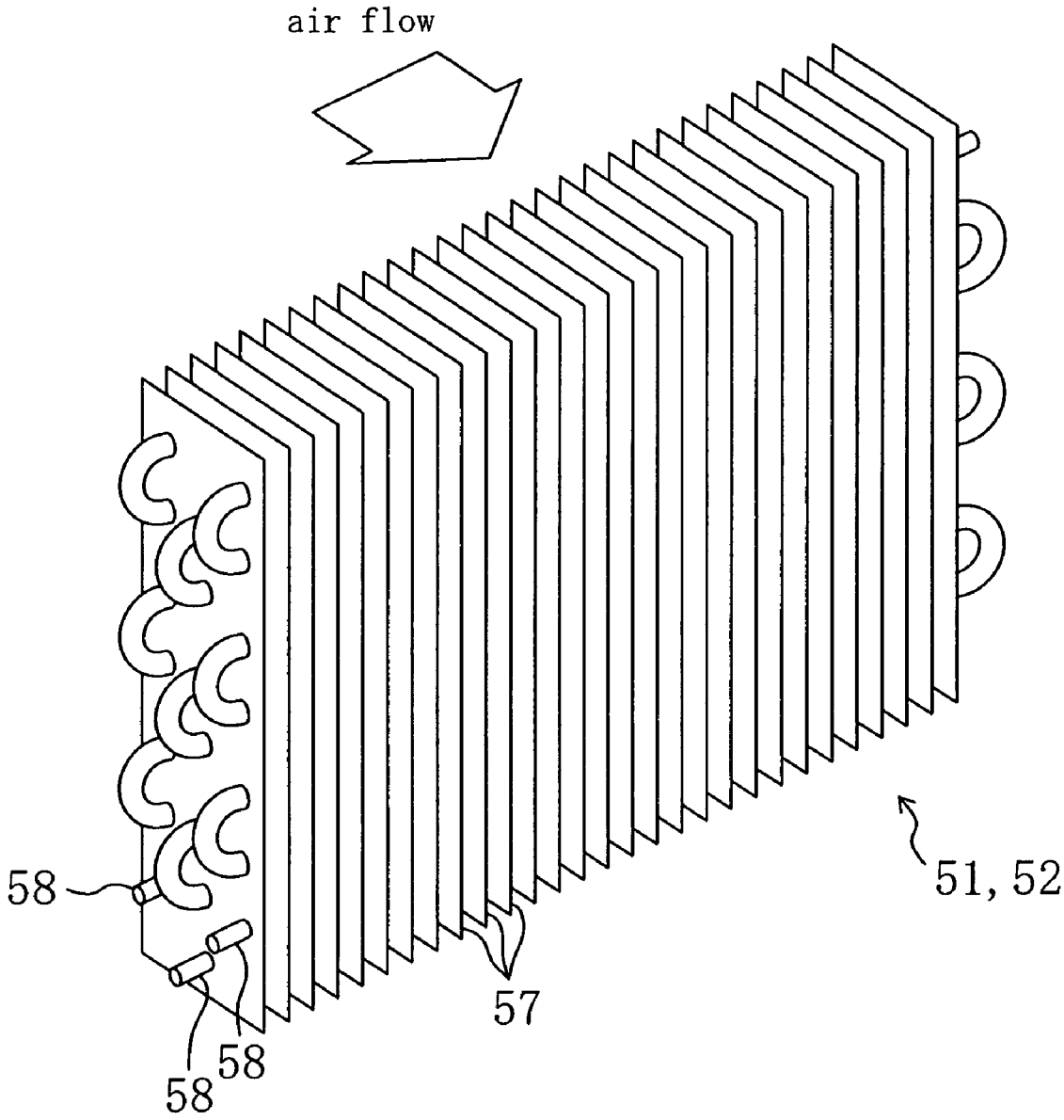
FIG. 2 is a schematic perspective view of an adsorption heat exchanger.

As shown in FIG. 2, the first and second adsorption heat exchangers (51, 52) are formed of cross fin type fin-and-tube heat exchangers. Each adsorption heat exchanger (51, 52) includes heat exchange tubes (58) made of copper and fins (57) made of aluminium. The plurality of fins (57) of each adsorption heat exchanger (51, 52) are formed in the shape of a rectangular plate and arranged at regular intervals. The heat exchange tubes (58) are provided to pass through the fins (57).

In each adsorption heat exchanger (51, 52), an adsorbent is carried on the surface of each fin (57) and, thus, air passing through between each adjacent pair of fins (57) comes into contact with the adsorbent on the surfaces of the fins (57). Examples of materials applicable as the adsorbent include materials that can adsorb vapor in air, such as zeolite, silica gel, activated carbon, organic polymeric materials with hydrophilic functional groups.

The humidity control system (10) includes a controller (30). The controller (30) includes an operation control means (31) for controlling the humidity control operation and also includes an opening control means (32) for the expansion valve (55), an initialization means (33), a correction means (34), an opening decreasing means (35) and an opening increasing means (36).

The operation control means (31) is configured to allow the humidity control system (10) to operate alternately in a first batch mode of adsorbing moisture in air on the second adsorption heat exchanger (52) and releasing moisture from the first adsorption heat exchanger (51) to air and a second batch mode of adsorbing moisture in air on the first adsorption heat exchanger (51) and releasing moisture from the second adsorption heat exchanger (52) to air and supply humidity-controlled air, which is dehumidified air or humidified air, to the room. The operation control means (31) is configured to change the batch mode, for example, every three minutes.

The opening control means (32) controls the opening of the expansion valve (35). Specifically, when a valve control start time has come a predetermined time after the start of each batch mode, the opening control means (32) controls the opening of the expansion valve (35) so that the degree of superheat of the refrigerant in the refrigerant circuit (50) reaches a predetermined value. Furthermore, the opening control means (32) is configured to keep the opening of the expansion valve (55) at a fixed value until the valve control start time in each batch mode has come.

Figure 3:
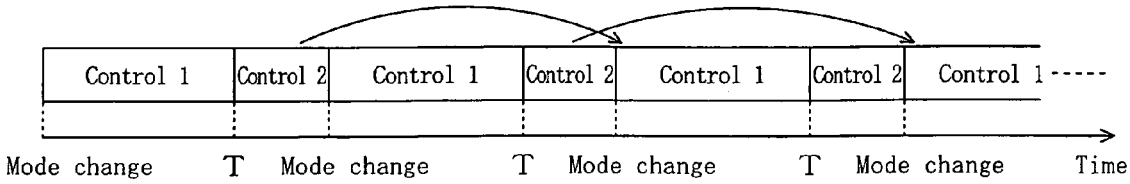
FIG. 3 is a timing diagram showing the control on the opening of an expansion valve.

For example, as shown in FIG. 3, the opening control means (32) selects as a valve control start time T the point of time at which 168 seconds have passed since the start of each batch mode, and executes Control 1, a control to keep in principle the opening of the expansion valve (55) at a fixed degree, until 168 seconds after the start of the batch mode. Furthermore, after 168 seconds have passed since the start of the batch mode, the opening control means (32) executes Control 2, a control to change the opening of the expansion valve (55) so that the degree of superheat of the refrigerant in the refrigerant circuit (50) reaches the specified valve.

The initialization means (33) sets the initial opening control value of the opening control means (32) for each batch mode to allow, upon start of each first batch mode, the opening of the expansion valve (55) to be fixed to that at the end of the preceding first batch mode and allow, upon start of each second batch mode, the opening of the expansion valve (55) to be fixed to that at the end of the preceding second batch mode. Furthermore, the initialization means (33) is configured, when in setting the initial opening control value of the opening control means (32) for one of the first and second batch modes the opening of the expansion valve (55) at the end of the preceding batch mode does not exist, to set the initial opening control value based on the opening of the expansion valve (55) at the end of the other batch mode.

In other words, as shown in FIG. 3, the initialization means (33) is configured so that the opening of the expansion valve (55) at the start of each batch mode follows that in the batch mode of the same type.

The correction means (34) is configured, upon change in the capacity of the compressor (53), to correct the opening control value of the opening control means (32) to allow the opening of the expansion valve (55) to reach a degree according to the change in the capacity of the compressor (53).

The opening decreasing means (35) is configured, when the degree of superheat of the refrigerant in the refrigerant circuit (50) falls below a target value before the valve control start time T in each batch mode comes, to decrease the opening control value of the opening control means (32) to allow the opening of the expansion valve (55) to be reduced.

The opening increasing means (36) is configured, when the degree of superheat of the refrigerant in the refrigerant circuit (50) rises above a specified degree of superheat before the valve control start time T in each batch mode comes, to increase the opening control value of the opening control means (32) to allow the opening of the expansion valve (55) to be increased.

—Operational Behavior—

Next, a description is given of the operational behavior of the humidity control system (10) of this embodiment. The humidity control system (10) of this embodiment performs a dehumidification operation and a humidification operation.

Furthermore, the humidity control system (10) during the dehumidification operation and the humidification operation controls the humidity of outside air (OA) taken therein and supplies the controlled air as supply air (SA) to the room and, concurrently, exhausts room air (RA) taken therein as exhaust air (EA) to the outside. In short, the humidity control system (10) during the dehumidification operation and the humidification operation ventilates the room.

Furthermore, the humidity control system (10), during each of the dehumidification operation and the humidification operation, operates alternately in the first batch mode and the second batch mode at specified time intervals (for example, at intervals of three minutes).

During the dehumidification operation, the humidity control system (10) takes in outside air (OA) and room air (RA) as the first and second airs, respectively. On the other hand, during the humidification operation, the humidity control system (10) takes in room air (RA) and outside air (OA) as the first and second airs, respectively.

First, the first batch mode is described. In the first batch mode, the second air is sent to the first adsorption heat exchanger (51) and the first air is sent to the second adsorption heat exchanger (52). In this first batch mode, a regeneration action for the first adsorption heat exchanger (51) and an adsorption action for the second adsorption heat exchanger (52) are carried out.

As shown in FIG. 1A, in the refrigerant circuit (50) during the first batch mode, the four-way selector valve (54) is set to the first position. When the compressor (53) is activated, refrigerant circulates in the refrigerant circuit (50). Specifically, refrigerant discharged from the compressor (53) releases heat in the first adsorption heat exchanger (51) to condense itself. The refrigerant condensed in the first adsorption heat exchanger (51) is reduced in pressure during passage through the expansion valve (55) and then absorbs heat in the second adsorption heat exchanger (52) to evaporate. The refrigerant evaporated in the second adsorption heat exchanger (52) is sucked into the compressor (53), compressed in it and discharged from the compressor (53) again.

In this manner, in the refrigerant circuit (50) during the first batch mode, the first adsorption heat exchanger (51) serves as a condenser and the second adsorption heat exchanger (52) serves as an evaporator. In the first adsorption heat exchanger (51), the adsorbent on the surfaces of the fins (57) is heated by the refrigerant in the heat exchange tubes (58) and moisture desorbed from the heated adsorbent is given to the second air. On the other hand, in the second adsorption heat exchanger (52), moisture in the first air is adsorbed on the adsorbent on the surfaces of the fins (57) and the heat of adsorption thus produced is absorbed by the refrigerant in the heat exchange tubes (58).

Furthermore, when the humidity control system (10) is in a dehumidification operation, the first air dehumidified by the second adsorption heat exchanger (52) is supplied to the room and moisture desorbed from the first adsorption heat exchanger (51) is exhausted to the outside together with the second air. On the other hand, when the humidity control system (10) is in a humidification operation, the second air humidified by the first adsorption heat exchanger (51) is supplied to the room and the first air having given moisture to the second adsorption heat exchanger (52) is exhausted to the outside.

Next, the second batch mode is described. In the second batch mode, the first air is sent to the first adsorption heat exchanger (51) and the second air is sent to the second adsorption heat exchanger (52). In this second batch mode, a regeneration action for the second adsorption heat exchanger (52) and an adsorption action for the first adsorption heat exchanger (51) are carried out.

As shown in FIG. 1B, in the refrigerant circuit (50) during the second batch mode, the four-way selector valve (54) is set to the second position. When the compressor (53) is activated, refrigerant circulates in the refrigerant circuit (50). Specifically, refrigerant discharged from the compressor (53) releases heat in the second adsorption heat exchanger (52) to condense itself. The refrigerant condensed in the second adsorption heat exchanger (52) is reduced in pressure during passage through the expansion valve (55) and then absorbs heat in the first adsorption heat exchanger (51) to evaporate. The refrigerant evaporated in the first adsorption heat exchanger (51) is sucked into the compressor (53), compressed in it and discharged from the compressor (53) again.

In this manner, in the refrigerant circuit (50), the second adsorption heat exchanger (52) serves as a condenser and the first adsorption heat exchanger (51) serves as an evaporator. In the second adsorption heat exchanger (52), the adsorbent on the surfaces of the fins (57) is heated by the refrigerant in the heat exchange tubes (58) and moisture desorbed from the heated adsorbent is given to the second air. On the other hand, in the first adsorption heat exchanger (51), moisture in the first air is adsorbed on the adsorbent on the surfaces of the fins (57) and the heat of adsorption thus produced is absorbed by the refrigerant in the heat exchange tubes (58).

Furthermore, when the humidity control system (10) is in a dehumidification operation, the first air dehumidified by the first adsorption heat exchanger (51) is supplied to the room and moisture desorbed from the second adsorption heat exchanger (52) is exhausted to the outside together with the second air. On the other hand, when the humidity control system (10) is in a humidification operation, the second air humidified by the second adsorption heat exchanger (52) is supplied to the room and the first air having given moisture to the first adsorption heat exchanger (51) is exhausted to the outside.

—Control Action on Expansion Valve—

Next, a description is given of the control on the opening of the expansion valve (55) in the humidity control system (10).

As described previously, the humidity control system (10) is operated to switch its operation mode between the first batch mode and the second batch mode every three minutes by the operation control means (31). Therefore, the opening control means (32) in principle executes Control 1, a control to keep the expansion valve (55) at a fixed opening, until the valve control start time T in each batch mode has come, i.e., until 168 seconds after the switching to the batch mode and the start thereof. When the valve control start time T has come, i.e., after 168 seconds have passed since the start of the batch mode, the opening control means (32) executes Control 2, a control to change the opening of the expansion valve (55) so that the degree of refrigerant superheat reaches a specified valve, 5° C.

The reason for this is as follows. A change from one batch mode to another in a short time will involve that the next mode change has taken place before the degree of superheat in the batch mode is stabilized. To cope with this, the opening control means (32) in principle controls the expansion valve (55) in terms of degree of superheat immediately before the end of each batch mode. This control action on the opening control means (32) is carried out for each batch mode.

Furthermore, since a fixed opening control value of the opening control means (32) must be determined, the initialization means (33) sets the fixed opening control value of the opening control means (32). Specifically, the initialization means (33) sets the fixed opening control value to allow, upon start of the first batch mode, the opening of the expansion valve (55) to be fixed to that at the end of the preceding first batch mode and allow, upon start of the second batch mode, the opening of the expansion valve (55) to be fixed to that at the end of the preceding second batch mode.

The reason for this is as follows. Since the first and second batch modes are different in the direction of refrigerant circulation, refrigerant pressure loss and air pressure loss in the air passage, they are different in the opening of the expansion valve (55). Therefore, the opening of the expansion valve (55) at the start of each first batch mode follows that in the preceding first batch mode and the opening of the expansion valve (55) at the start of each second batch mode follows that in the preceding second batch mode.

If the degree of refrigerant superheat falls below the target value before the valve control start time T in each batch mode comes and when the expansion valve (55) is controlled to keep the fixed opening by the opening control means (32), the opening decreasing means (35) controls the opening control means (32) to reduce the opening of the expansion valve (55).

On the other hand, if the degree of refrigerant superheat rises above the specified degree of superheat before the valve control start time T in each batch mode comes and when the expansion valve (55) is controlled to keep the fixed opening by the opening control means (32), the opening increasing means (36) controls the opening control means (32) to increase the opening of the expansion valve (55).

The reason for this is as follows. It takes a certain time to stabilize the fixed opening control value of the opening control means (32) set by the initialization means (33) after the compressor (53) is activated to start the dehumidification operation or humidification operation. Specifically, the degree of refrigerant superheat may significantly rise or drop after the switch to each batch mode. To cope with this, the opening decreasing means (35) or the opening increasing means (36) controls the opening control means (32) to change the opening of the expansion valve (55).

Thereafter, as the opening control value of the opening control means (32) is changed by the control of the opening decreasing means (35) and the opening increasing means (36), the opening of the expansion valve (55) is stabilized.

Figure 4:
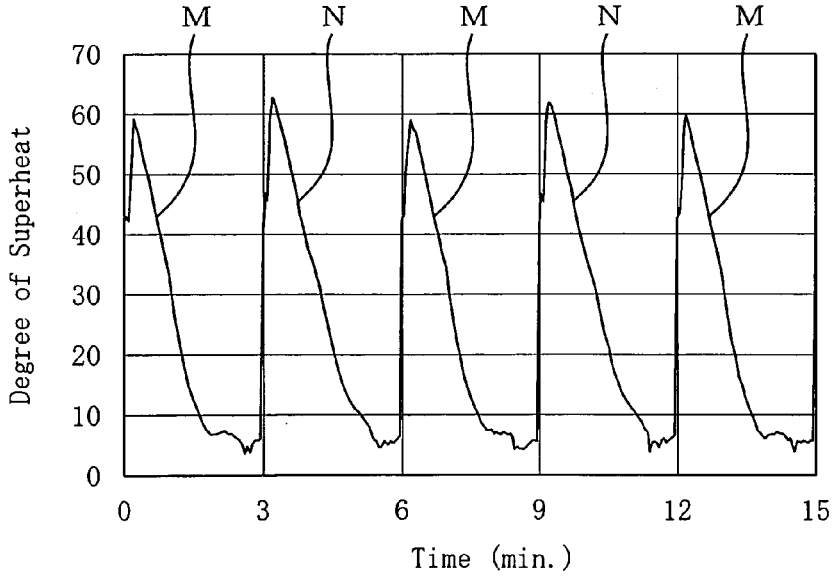
FIG. 4 is a plot showing changes in the degree of refrigerant superheat.

When the above-described control on the expansion valve (55) is repeated, the opening of the expansion valve (55) is stabilized. For example, as shown in M and N in FIG. 4, after the switch to each batch mode, the degree of refrigerant superheat abruptly rises, then drops and reaches the specified degree before the switch to the next batch mode.

When the capacity of the compressor (53) changes, the correction means (34) corrects the opening control value of the opening control means (32) to allow the opening of the expansion valve (55) to reach a degree according to the change in the capacity of the compressor (53).

Furthermore, when in setting the initial opening control value of the opening control means (32) for one of the first and second batch modes the opening of the expansion valve (55) at the end of the preceding batch mode does not exist, the initialization means (33) sets the initial opening control value based on the opening of the expansion valve (55) at the end of the other batch mode.

Effects of Embodiment

According to this embodiment, as described previously, the opening of the expansion valve (55) is controlled, when the valve control start time comes after the start of each batch mode, so that the degree of refrigerant superheat reaches the predetermined value. Therefore, the opening of the expansion valve (55) can be relatively stably controlled. To be more specific, since each batch mode is changed to the other batch mode in a short time, the degree of refrigerant superheat may significantly change in each batch mode. To cope with this, the opening of the expansion valve (55) is controlled near the end of each batch mode so that the degree of refrigerant superheat reaches the predetermined value. Thus, a stable control on the opening of the expansion valve (55) can be implemented.

Furthermore, since the opening of the expansion valve (55) is kept at a fixed value from the start of each batch mode to the valve control start time, the control on the opening of the expansion valve (55) can be stabilized.

Furthermore, since the opening of the expansion valve (55) is decreased when the degree of refrigerant superheat falls below the target value before the valve control start time T in each batch mode, so-called wet operation can be prevented, thereby preventing return of liquid refrigerant to the compressor (53).

Furthermore, since the opening of the expansion valve (55) is increased when the degree of refrigerant superheat rises above the specified degree before the valve control start time T in each batch mode, the superheating of the compressor (53) can be surely prevented.

Furthermore, since the opening of the expansion valve (55) is fixed, upon start of the first batch mode, to the opening thereof at the end of the preceding first batch mode and, upon start of the second batch mode, to the opening thereof at the end of the preceding second batch mode, the opening of the expansion valve (55) can be rapidly brought to an appropriate value.

Specifically, since the first and second batch modes are different in the direction of refrigerant circulation, refrigerant pressure loss and air pressure loss in the air passage, they are different in the opening of the expansion valve (55). Therefore, the opening of the expansion valve (55) at the start of each first batch mode follows that in the preceding first batch mode and the opening of the expansion valve (55) at the start of each second batch mode follows that in the preceding second batch mode. Thus, the opening of the expansion valve (55) can be brought to the appropriate value.

Furthermore, when the capacity of the compressor (53) changes, the opening control value of the opening control means (32) is corrected so that the expansion valve (55) can reach the opening according to the change in the capacity of the compressor (53). Therefore, the expansion valve (55) can be controlled to an opening adaptable to the operating conditions, which stabilizes the opening of the expansion valve (55).

Furthermore, when in setting the initial opening control value of the opening control means (32) for one of the first and second batch modes the opening of the expansion valve (55) at the end of the preceding batch mode does not exist, the initial opening control value can be set based on the opening of the expansion valve (55) at the end of the other batch mode. Therefore, the opening of the expansion valve (55) can be fixed to an opening approximately according to the operating conditions and can be then rapidly brought to the appropriate value.

Other Embodiments

The present invention is not limited to the humidity control system (10) including the refrigerant circuit (50) described in the above embodiment and is applicable to any humidity control system (10) including a refrigerant circuit (50) with an expansion valve (55) adjustable in opening.

Furthermore, the switching interval of the batch mode and the valve control start time are not limited to those in the above embodiment.

The above embodiment is merely illustrative in nature and is not intended to limit the scope, applications and use of the present invention.

INDUSTRIAL APPLICABILITY

As can be seen from the above description, the present invention is useful for humidity control systems (10) including a refrigerant circuit with an expansion valve adjustable in opening.

The invention claimed is:

1. A humidity control system that includes a refrigerant circuit including a compressor, a first heat exchanger carrying an adsorbent thereon, an expansion valve adjustable in opening and a second heat exchanger carrying an adsorbent thereon and supplies humidity-controlled air to a room by operating alternately in a first batch mode in which the second heat exchanger adsorbs moisture in air and the first heat exchanger releases moisture to air and a second batch mode in which the first heat exchanger adsorbs moisture in air and the second heat exchanger releases moisture to air, the humidity control system comprising:

an opening control means that, when a valve control start time has come a predetermined time after the start of each of the first and second batch modes, controls the opening of the expansion valve so that the degree of superheat of refrigerant in the refrigerant circuit reaches a predetermined value, wherein the opening control means is configured to keep the opening of the expansion valve at a fixed value until the valve control start time in each of the first and second batch modes has come.

2. The humidity control system of claim 1, further comprising an opening decreasing means that, when the degree of superheat of the refrigerant in the refrigerant circuit falls below a target value before the valve control start time in each of the first and second batch modes comes, decreases the opening control value of the opening control means to allow the opening of the expansion valve to be reduced.

3. The humidity control system of claim 1, further comprising an opening increasing means that, when the degree of superheat of the refrigerant in the refrigerant circuit rises above a specified degree of superheat before the valve control start time in each of the first and second batch modes comes, increases the opening control value of the opening control means to allow the opening of the expansion valve to be increased.

* * * * *